United States Patent [19]

DeJong et al.

[11] 3,950,667

[45] Apr. 13, 1976

[54] MAGNETIC DEFLECTION CATHODE RAY TUBE SYSTEM WITH ELECTRON GUN HAVING FOCUS STRUCTURE OF A DEPOSITED RESISTIVE MATERIAL

[75] Inventors: Arthur E. DeJong, Bellflower; Neal H. Cosand, Fullerton, both of Calif.

[73] Assignee: Hughes Aircraft Company, Culver City, Calif.

[22] Filed: Sept. 6, 1974

[21] Appl. No.: 503,893

Related U.S. Application Data

[63] Continuation of Ser. No. 376,263, July 3, 1973, which is a continuation of Ser. No. 194,381, Nov. 1, 1971, abandoned.

[52] U.S. Cl. ..... 313/450; 313/440

[51] Int. Cl.[2] ..... H01J 29/46; H01J 29/62

[58] Field of Search ..... 313/450, 458, 460, 449, 313/448, 451, 444

[56] References Cited

UNITED STATES PATENTS

| | | | |
|---|---|---|---|
| 2,178,973 | 11/1939 | Shoenberg et al. | 313/449 |
| 2,771,566 | 11/1956 | Baracket | 313/450 X |
| 3,223,871 | 12/1965 | Schlesinger | 313/450 |
| 3,355,617 | 11/1967 | Schwartz et al. | 313/450 |
| 3,383,537 | 5/1968 | Marshall | 313/444 |
| 3,549,229 | 12/1970 | Moegenbier | 313/94 |

*Primary Examiner*—Robert Segal
*Attorney, Agent, or Firm*—Walter J. Adam; W. H. MacAllister

[57] ABSTRACT

A high speed electromagnetic deflected electrostatic focus cathode ray tube display having a relatively short magnetic time constant by controlling the gun structure. The volume resistivity and the thickness of resistive materials used in the neck of the cathode ray tube that are cut by changing magnetic flux fields, are selected to provide a relatively short time constant. In one arrangement, the tube focusing control elements near the deflection yoke are formed on a precision ground structure of glass or other suitable ceramic materials. In another arrangement the elements of the tube that are intercepted by the changing magnetic flux are deposited or formed on a precision ground portion of the tube neck. Material deposited on the tube structure or on the tube neck is of a selected maximum volume resistivity and a selected small thickness so that the overall operation has a relatively short time constant.

2 Claims, 8 Drawing Figures

Fig. 2.
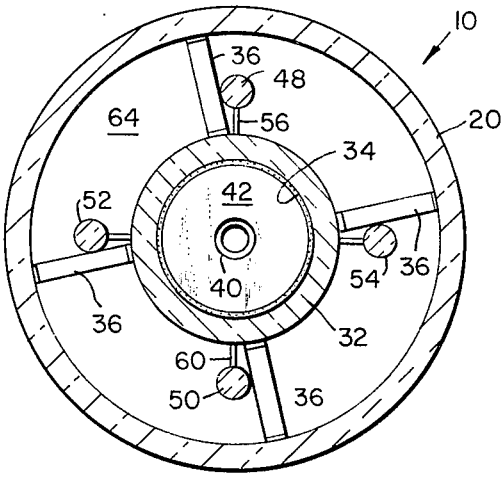
Fig. 4.
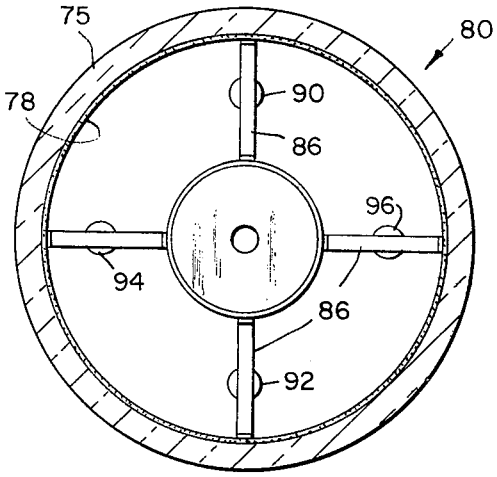
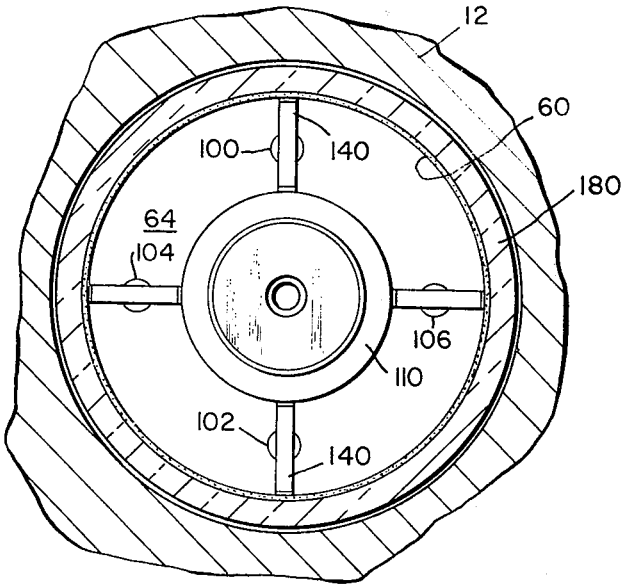
Fig. 6.
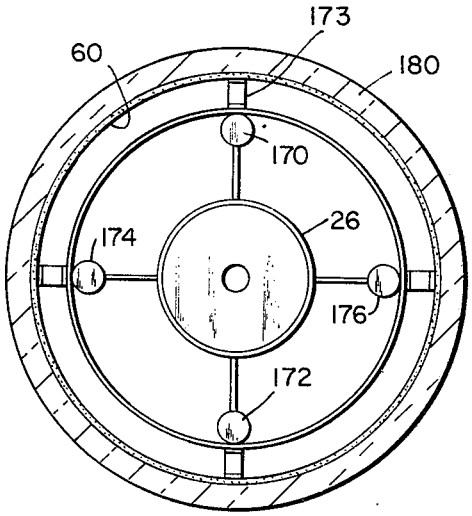
Fig. 8.

MAGNETIC DEFLECTION CATHODE RAY TUBE SYSTEM WITH ELECTRON GUN HAVING FOCUS STRUCTURE OF A DEPOSITED RESISTIVE MATERIAL

This is a continuation of application Ser. No. 376,263, filed July 3, 1973, which in turn is a continuation of application Ser. No. 194,381 filed Nov. 1, 1971, now abandoned.

BACKGROUND OF THE INVENTION

1. Field of the Invention

This invention relates to cathode ray tube structures and particularly to a high speed cathode ray tube using electromagnetic deflection.

2. Description of the Prior Art

High speed operation of cathode ray tubes means that the time constant $\tau$ for the eddy currents induced in the components of the CRT (cathode ray tube) must be compatible with a high speed deflection system. For a four microsecond electromagnetic system, for example, the $\tau$ of the CRT should be less than 100 nanoseconds in order for the displayed spot to settle within 0.05% for a large deflection across the screen. Some of the best known high resolution type CRT tubes today have a $\tau$ in order of 1,000 nanoseconds which is an order magnitude higher than is normally required. One method to increase the speed of electromagnetic cathode ray tube systems is to extend the length of the CRT neck so that the gun structure is out of range of the changing flux field including the fringing flux developed by the yoke. However, selection of relatively long tubes is undesirable for many applications because the increased length in the CRT causes an increased depth in the cabinet in which the CRT is mounted. It would be a substantial advantage to the high speed display art if a magnetic display tube system were developed having a relatively short time constant without requiring an increase of tube length.

SUMMARY OF THE INVENTION

Magnetic deflection tube structures are provided in accordance with the invention, having volume resistivity and thickness of the materials which are cut by the changing flux field produced by the yoke, controlled or selected so that the tube has a relatively low time constant. In one arrangement in accordance with the invention electrodes cut by the changing flux field are formed by deposition on a precision ground barrel or tube that is rod mounted in the neck of the tube. In another arrangement in accordance with the invention, the electrodes cut by the changing flux field are deposited on the precision ground inner surface of the neck of the tube so that the inner wall of the envelope is integral with the focus barrel. In all the arrangements in accordance with the invention the high speed operation is achieved by minimizing the cylinder thickness of the electrodes and by maximizing the volume resistivity.

It is therefore an object of this invention to provide an electromagnetic deflected tube having a high speed or a relatively short magnetic time constant.

It is a further object of this invention to provide a cathode ray tube having a high speed and having a relatively short neck.

It is another object of this invention to provide a simplified and reliable cathode ray tube for magnetic deflection at a relatively high speed that is constructed with a minimum of complexity.

It is a still further object of this invention to provide an improved cathode ray tube structure utilizing thin film techniques.

BRIEF DESCRIPTION OF THE DRAWINGS

The novel features of this invention as well as the invention itself both as to its method of organization and method of operation, will best be understood from the accompanying description, taken in connection with the accompanying drawings, in which like reference characters refer to like parts, and in which:

FIG. 2 is a schematic cross sectional view taken at line 2—2 of FIG. 1 for further explaining the high voltage focus tube thereof;

FIG. 4 is a schematic cross sectional view taken at line 4—4 of FIG. 3 for further explaining the high voltage focus tube thereof;

FIG. 6 is a schematic cross sectional view taken at line 6—6 of FIG. 5 for further explaining the low voltage focus tube thereof;

FIG. 8 is a schematic cross sectional view taken at line 8—8 of FIG. 7.

DESCRIPTION OF THE PREFERRED EMBODIMENT

Figure 1:
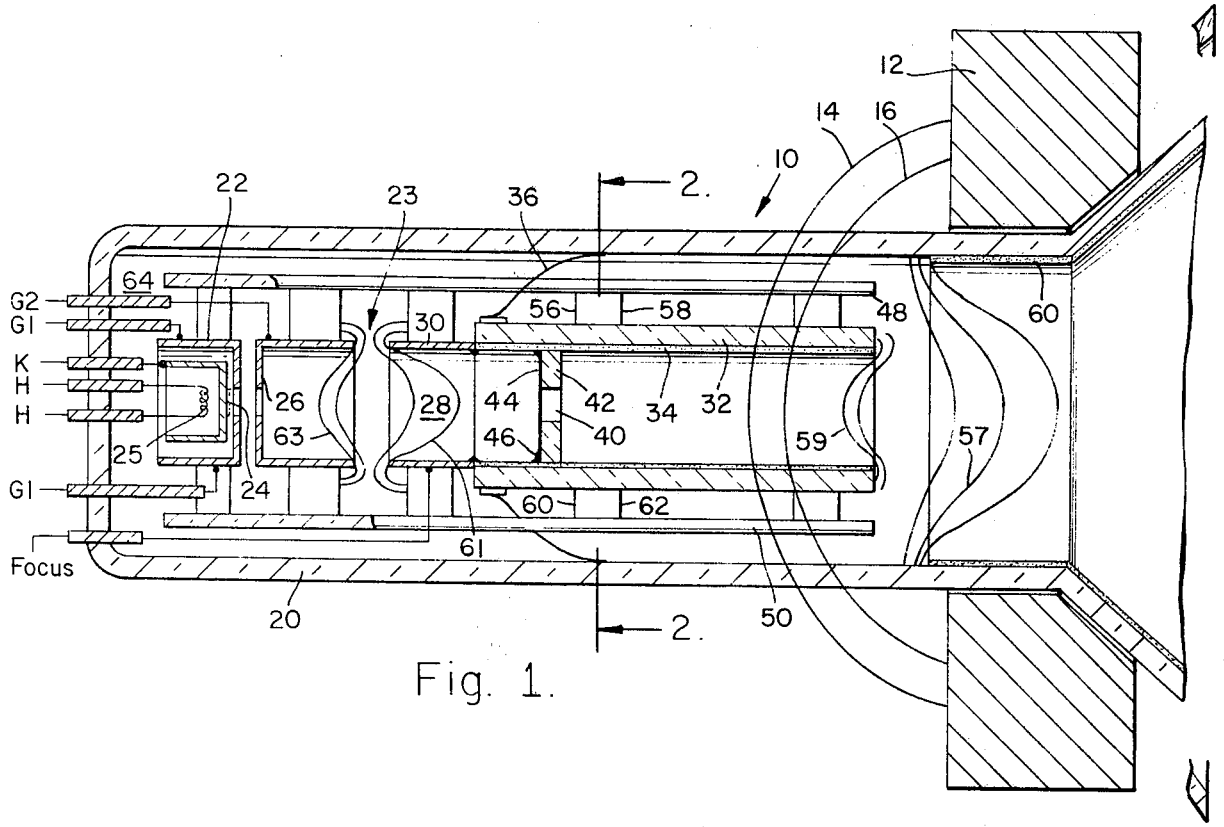
FIG. 1 is a schematic cross sectional diagram of a magnetic deflected high speed cathode ray tube in accordance with the invention having a high voltage focus electrode and a rod mounted gun.

Referring first to FIG. 1, the problem and general solution in accordance with the invention will be described before proceeding onto the different structures utilized for different type tube arrangements of the invention. In a magnetic deflection type cathode ray tube 10, a deflection yoke 12 may be positioned substantially at or near the bulb or expanding portion of the tube. In operation, the flux field changes as provided by the magnetic yoke 12 and fringing flux indicated by lines 14 and 16 intercepts the adjacent portions of the gun in the neck 20 of the tube. The time constants of the eddy currents in the focus barrel portion of the gun caused by the fringing flux essentially determines the overall effective time constant of the cathode ray tube. The time constant $\tau$ of the focusing structure or focus barrel caused by eddy currents induced in the conductive or resistive material is given by the following equation:

$$\tau = \frac{\mu t^2}{\pi^2 \rho}$$

where $\tau$ = the time constant in seconds, $\mu = \mu_0 \cdot \mu_r$ or the permeability, where $\mu_0$ is the magnetic permeability of free space and $\mu_r$ is the relative permeability of the material, t = thickness of the cylinders in centimeters intercepted by the lines of flux, and $\rho$ = bulk resistivity of the material in micro-ohm cm. The bulk resistivity is the resistance of a cube 1 cm on each side between plates placed on two opposite sides of the cube.

In order to obtain a fast $\tau$ in accordance with the invention, the cylinder thickness or portions of the gun intercepted by the changing flux is minimized such as by a deposited film of material and the gun at the portions intercepted by the flux is selected of a resistive material in which the volume resistivity is a relatively large maximum.

The electron gun structure of the tube 10 of FIG. 1 is for a high voltage focus electrode CRT in which an electron gun 23 is rod mounted in the neck 20. A G1 electrode or structure 22 is provided with a typical opening and with a cathode 24 at the opening and a heater coil 25 adjacent thereto. The G2 structure or electrode 26 is positioned adjacent to and forward from the G1 structure and may be of a typical ring type. Next in order in the neck of the tube is the focus structure or electrode 28 having a portion 30 which may be of a conventional type configuration and material. The structures 22, 26 and 30 may conventionally be of stainless steel, as is well known in the art. Focus structure 28 also includes a barrel or hollow cylinder 32 which may be of a precision ground glass or ceramic material and is coated on the inner surface with a low volume resistivity material such as graphite (which is formed from graphite suspended in water) to form a surface coating 34 or is coated with any suitable resistive material as will be described subsequently. The structure 30 is mounted and electrically connected to the coating 34 and a suitable snubber 36 is mechanically connected to the tube 32. To provide an aperture 40 in the focus barrel, a structure or ring 42 having a resistive material such as graphite positioned as a surface coating 44 is mounted within the coating surface 34 and welded into position therearound as indicated at 46.

Referring now also to FIG. 2, it can be seen that the snubber 36 may have four extensions for contacting the inner surface of the neck 20 and that glass rods 48 and 50 and 52 and 54 are provided for mounting the cylinder 32 with suitable pins which may be metallic, such as pins 56, 58, 60 and 62. The electrodes 22, 26 and 30 are also mounted with pins to the glass rods in a conventional manner. It is to be noted that in the arrangement of FIG. 1, the snubber 36 is positioned sufficiently far from the fringing flux so as to not interfere therewith but sufficiently far forward to provide rigidity to the gun structure. In other arrangements in accordance with the invention, the snubber may be utilized forward in the normal manner near the yoke structure if it is selected of a relatively low volume resistivity material or by its configuration is sufficiently small in cross section and has a sufficiently small thickness t to not substantially change the time constant of the magnetic tube operation. Also, the pins in the tubes of the invention may be selected of a desirably small diameter to minimize any effect on the time constant. Deposited on the inner surface of the tube near and in the expanding portion is the A3 or accelerator electrode which may be formed of graphite or other suitable coating 60. To show that the structure conforms to operation requirements, equipotential lines such as 57, 59, 61 and 63 are shown.

In forming the gun structure 23, the tube 32 is precision ground in its inner surface and has the resistive material deposited as a thin film thereon by sputtering or by other vacuum deposition, for example. For example, a photoresist material properly masked may define the area to be coated by first coating the entire tube with resistive material, then etching away material not covered with photoresist. The sputtering onto the cylinder 32 then may be performed in a vacuum container. The thickness of the coating 34 may be controlled to be relatively small during vacuum deposition. The ring 42 has the surface 44 deposited thereon in a similar manner and is then inserted into the tube 32 and welded into place. The connection is then formed between the surface 34 and the electrode 30 by welding and the snubber 36 is positioned along with the G1 and G2 electrodes 22 and 26. The structure is then pin mounted to the glass rods with a hot flame as is well known in the art, and is then inserted into the neck 20 with the snubbers and the metallic electrical leads 64 providing the support. The above described operation is applicable to the other tube structures of the invention having an inner rod mounted cylinder as well as being generally applicable to those tubes having resistive coating on the inner surface of the tube neck. The electrode pins projected through the end of the neck 20 in a conventional manner will include pins G1, K, H, H, G1 and G2 and focus respectively representing the control grid, cathode, heater, heater, control grid and first anode. The pins may have voltages applied thereto as follows, which voltages are an illustrative example of one set of values that may be utilized in accordance with the principles of the invention.

$G1 = -70$ volts $G2 = +400$ volts $H = 6.3$ volts rms $K = 0$ volts focus = 2,000 to 5,000 volts $A3 = 15$ KV.

The A3 voltage may be applied at a suitable terminal (not shown) at the expanding portion of the tube as is well known in the art.

Figure 3:
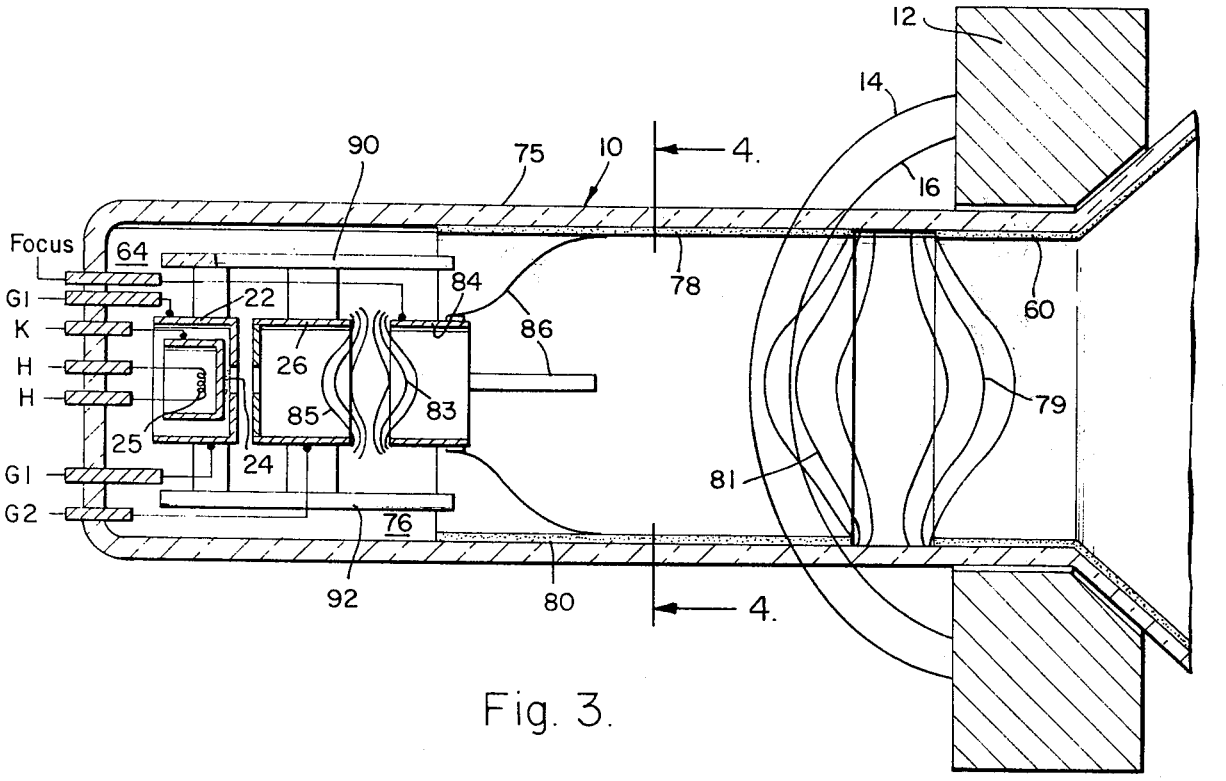
FIG. 3 is a schematic cross sectional diagram of a magnetic deflected, high speed cathode ray tube in accordance with the invention having a high voltage focus electrode and in which the inner wall of the envelope or tube neck is integral with the focus barrel.

Referring now to FIG. 3, the CRT tube 10 is shown for a high voltage focus type gun with the inner wall of the neck of the tube being integral with the focus barrel. The gun 76 includes a G1 structure 22 and a G2 structure 26 as well as leads 64 with their extending pins similar to that explained relative to FIG. 1. The focus electrode or barrel is formed principally of a surface 78 deposited on an inner surface of the neck 75 which is precision ground at the inner surface 80. The surface 78 may be graphite or any suitable material. The focus electrode also includes a ring 84 having a snubber 86 extending to the surface 78 for providing support as well as an electrical connection. Glass tubes 90 and 92 as well as 94 and 96 as may be seen in the section of FIG. 4, are utilized to mount the structures 22, 26 and 84 by suitable pins with the rod mounted structure being held rigid by the leads 64 and the snubber 86. The surface 78 extends back beyond the forward edge of the ring 84 so as to provide eliminate potential discontinuities in this area. The tube of FIG. 3 is manufactured by precision grinding the inner surface at the neck 75 at the required positions, establishing the film or surface 78 by suitable means such as masking and vacuum deposition or sputtering and inserting the gun structure 70 into the tube neck so that the snubber is positioned and then sealing the neck at the end thereof. As shown by the fringing flux lines 14 and 16 substantially none of the changing flux passes through the focus lens except through the controlled surface 78 which is selected with a desired minimum thickness t and a desired volume resistivity. Equipotential lines such as 79, 81, 83 and 85 are shown to illustrate that suitable electrostatic focusing is provided.

Figure 5:
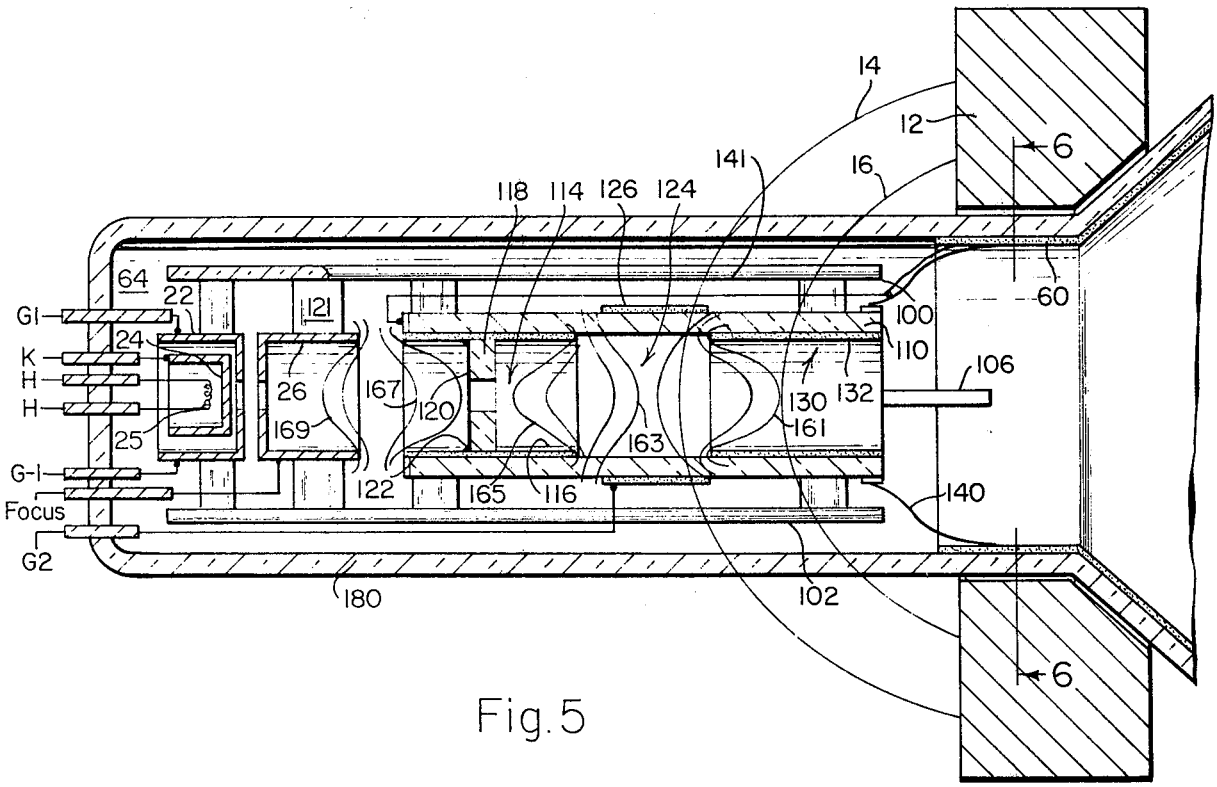
FIG. 5 is a schematic cross sectional diagram of a high speed magnetic deflected cathode ray tube in accordance with the invention having a low voltage focus electrode and having a rod mounted gun.
Figure 7:
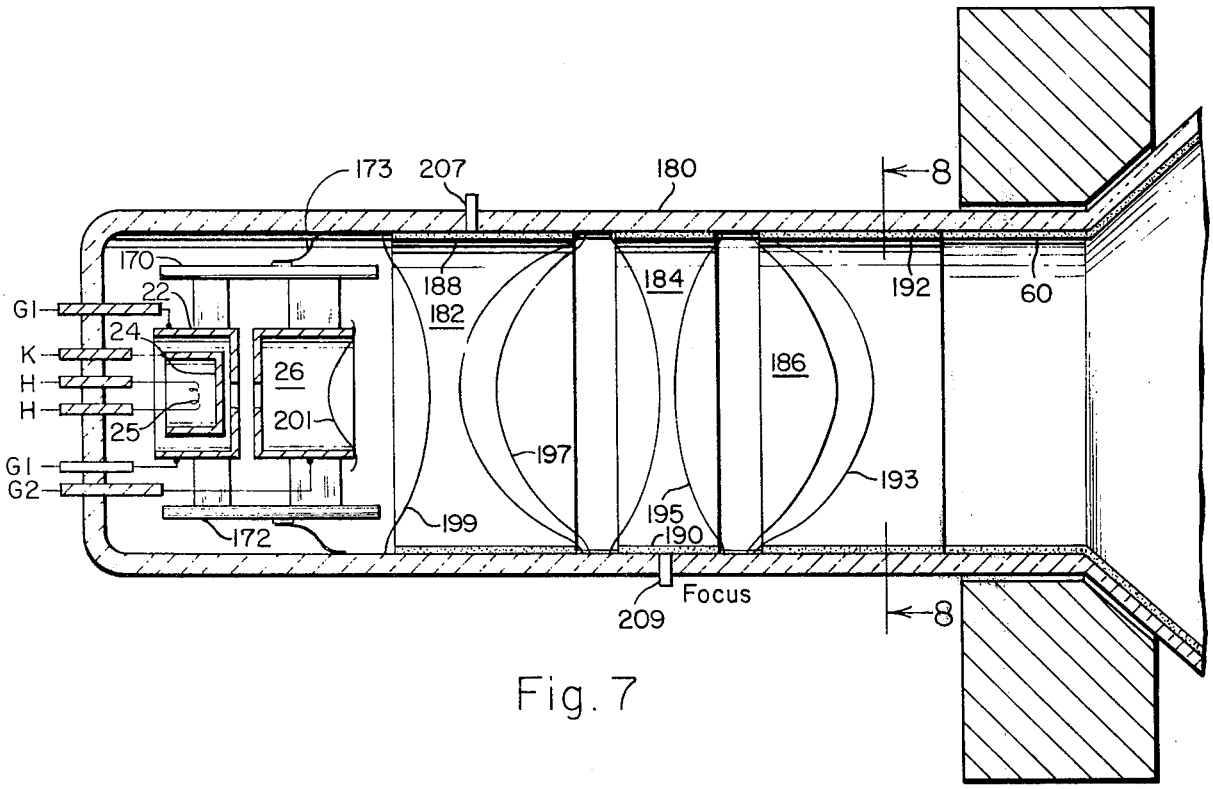
FIG. 7 is a schematic cross sectional diagram of a magnetic deflected cathode ray tube in accordance with the invention having a low voltage focus electrode and in which the inner wall of the envelope is integral with the focus barrel.

Referring now to FIG. 5, a low voltage focus tube having magnetic deflection with a rod mounted gun 121 is shown in accordance with the principles of the invention. In this arrangement, the G1 structure 22 and the G2 structure 26 are similar to those previously explained and are mounted with rods or glass rods 100, 102, 104 and 106 as may be seen in the section of FIG. 6. A glass tube 110, which may have precision ground inner and outer surfaces and which may be formed of any suitable material such as glass or ceramic is provided with the preaccelerator electrode 114, focus electrode 124 and an accelerator anode 130 formed thereon. The preaccelerator electrode 114 has a surface 116 deposited on the inner surface of the tube 110 and a ring structure 118 with a surface 120 deposited thereon and welded into position such as at 122. Focus structure 124 includes a surface 126 deposited on the outer surface of the tube 10 and formed of a suitable material such as graphite. The accelerator electrode 130 is formed of a surface 132 deposited on the inner surface of the tube 110. It is to be noted that the differences of diameters is provided so as to increase the resolution or decrease the spot size. The tube 110 is then mounted to the glass rods 100, 102, 104 and 106 by suitable pins so as to provide an entire single gun structure that may be inserted into the neck 10. A snubber 140, which may be a quartz fiber is utilized to stabilize the gun structure at the front end thereof. It is to be noted that other means for stabilizing the gun structure may be utilized within the principles of the invention. Also, because of the small cross sectional area of the snubber, it may be utilized of conventional stainless steel in some arrangements of FIG. 5 as well as other tubes in accordance with the invention by selecting a sufficiently small thickness without substantially affecting the time constant of operation. In another arrangement of FIG. 5 as well as other tubes in accordance with the invention, the snubber may be mounted substantially toward the middle of the glass rod so that it will not be in the path of the infringing flux of lines 14 and 16. As may be seen in the cross section of FIG. 6, the gun structure may be readily inserted into the tube neck 10. A focus lead is coupled to the cross structure 124 and the preaccelerator is electrically connected by a suitable conductor lead 146 to the accelerator 130. The coating 60 is connected to the accelerator 130 either through the snubber 140 or through a suitable lead 141. To illustrate the electrostatic fields provided, equipotential lines such as 161, 163, 165, 167 and 169 are shown. In the low voltage tube the following supply voltages may be utilized as an example:

$G1 = -70$ volts
$G2 = +400$ volts
$H = 6.3$ volts rms
$K = 0$ volts
focus $= +200$ volts $\pm 200$ volts Referring now to FIGS. 7 and 8, the low voltage focus tube for a magnetic deflection operation with the inner wall of the neck integral with the focus barrel will be explained. The G1 structure 22 and the G2 structure 26 are substantially similar as previously explained, mounted on rods 170, 172, 174 and 176. The neck 180 has an inner surface that is precision ground so as to have an even and smooth surface and a preaccelerator electrode 182, focus electrode 184 and accelerator electrode 186 are deposited thereon with respective surfaces 188, 190 and 192 formed of graphite or suitable material in accordance with the invention. It is to be noted that in the illustrated arrangement the diameter of the three electrodes 182, 184 and 186 is the same which may provide a spot size slightly larger than with a variation of the diameter. However, the principles of the invention may include grinding of the neck 180 so that different diameter positions are provided. The glass rods 170, 172, 174 and 176 may be mounted in the neck 180 by a snubber 173, in turn mounted to the rods by suitable metallic pins. The electrostatic fields are illustrated by equipotential lines such as 193, 195, 197, 199 and 201. The preaccelerator 182 may have an electrical pin connection 207 out of the neck 180, the focus electrode may have a pin connection 209 out of the neck 180, and the accelerator electrode 186 may continue to the surface accelerator 60.

In the system of the invention because the time constant is a function of the thickness squared, the intercepted electrode structures have a small thickness such as may be provided by a deposited surface. The material is selected with a high volume resistivity and any suitable resistive material such as graphite or nickel-chrome alloy may be utilized. Any metal in the area such as snubbers or mounting pins may be selected with a thickness consistent with the deposited structure so as to provide very little effect to the time constant. For example, if 10% of the flux is intercepted by a metal such as stainless steel having undesired characteristics, the final settling of the electron spot on the screen of the tube may require approximately 1 microsecond. However, if only 1% of the flux intercepts undesired structure, the final settling (within 0.05% for a large deflection) of the spot may be unnoticeable to the eye and not change the effective time constant.

Thus there has been described a high speed magnetic cathode ray tube deflection system in which by controlling the structure and the parameters of the material utilized in the gun relatively short cathode ray tubes may be utilized. It is to be noted that the principles of the invention are not to be limited to cathode ray tubes but are equally applicable to any tube where fast magnetic deflection is desired such as storage tubes, vidicons or image dissectors. In one arrangement, a separate cylinder structure is mounted within the tube and in the other arrangement, the inner surface of the neck of the tube is utilized for maintaining the electrode structure. Electrode structures may be graphite, nichrome alloy or any other suitable material which has a relatively large volume resistivity. The present gun structures are made of 305 stainless steel which has a resistivity of 72 micro-ohm centimeters and the system of the invention can utilize material such as a graphite and water solution sold under the name "Aquadag" which has greater than a thousand micro-ohm centimeters of volume resistivities. Also, since thickness squared controls the time constant, the illustrated structures allowing controlled deposition of relatively thin materials greatly decreases the time constant. Systems can be developed using the principles of the invention in which the $\tau$ is less than 100 nanoseconds to settle within 0.05% for a large deflection.

What is claimed is:

1. A high speed magnetic deflection cathode ray tube system having a selected magnetic deflection time constant comprising a glass envelope including a neck portion having first and second ends, a magnetic deflection yoke positioned at the second end of said neck portion and passing deflection flux through a predetermined portion of said neck portion, and an electron gun including a focus structure, means within said predetermined portion including at least a portion of said focus structure of said electron gun, said focus structure of said means within said predetermined portion including a tube of non-magnetic material having inner and outer surfaces and including a deposited film of a resistive material deposited on one or both of said surfaces, said resistive material being of a selected bulk resistivity $\rho$ and selected thickness t so said deposited film provides a selected time constant $\tau$ of said deposited film caused by the eddy currents induced therein by the deflection flux, in accordance with the relationship $$\tau = \frac{\mu t^2}{\pi^2 \rho}$$

where $\mu$ is the permeability of the resistive material, said means providing said time constant equal to or less than 100 nanoseconds.

2. The system of claim 1 in which said resistive material includes graphite.

* * * * *